US009994047B2

(12) United States Patent
Onodera

(10) Patent No.: US 9,994,047 B2
(45) Date of Patent: Jun. 12, 2018

(54) DRYING APPARATUS AND CONVEYING SYSTEM

(71) Applicant: Ken Onodera, Kanagawa (JP)

(72) Inventor: Ken Onodera, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days. days.

(21) Appl. No.: 15/366,164

(22) Filed: Dec. 1, 2016

(65) Prior Publication Data

US 2017/0157951 A1 Jun. 8, 2017

(30) Foreign Application Priority Data

Dec. 2, 2015 (JP) ..... 2015-235534
Oct. 21, 2016 (JP) ..... 2016-207183

(51) Int. Cl.
*B41J 2/01* (2006.01)
*B41J 11/00* (2006.01)
*B41M 5/00* (2006.01)

(52) U.S. Cl.
CPC ..... *B41J 11/002* (2013.01); *B41M 5/0017* (2013.01)

(58) Field of Classification Search
None
See application file for complete search history.

(56) References Cited

U.S. PATENT DOCUMENTS

2010/0105830 A1* 4/2010 Kaneko ..... B29C 41/28 524/599
2013/0293617 A1* 11/2013 Suzuki ..... B41J 11/002 347/16
2014/0232797 A1 8/2014 Onodera et al.
2015/0174921 A1 6/2015 Onodera et al.
2015/0346659 A1 12/2015 Nagayama et al.

FOREIGN PATENT DOCUMENTS

JP 2007-187821 7/2007
JP 2010-204235 9/2010

* cited by examiner

*Primary Examiner* — Erica Lin
(74) *Attorney, Agent, or Firm* — Cooper & Dunham LLP

(57) ABSTRACT

A drying apparatus includes a plurality of rollers including at least one heating roller and arranged to form a conveying path where a conveyed object is wound to be heated and conveyed. The plurality of rollers are arranged such that a first subset of rollers amongst the plurality of rollers is arranged on one side in a horizontal direction, and a second subset of rollers is arranged on an opposite side in the horizontal direction. The conveyed object is conveyed along the conveying path windingly back and forth between the first side and the second side, such that the winding conveyance back and forth between the first side and the second side advances the conveyed object upwardly or downwardly in a vertical direction. As an example, the conveying path includes plural horizontal sections, one disposed above another, and amongst the plural horizontal sections, each horizontal section is shorter than the horizontal sections below the horizontal section.

13 Claims, 10 Drawing Sheets

DRYING APPARATUS AND CONVEYING SYSTEM

CROSS-REFERENCE TO RELATED APPLICATIONS

The present application claims priority under 35 U.S.C. § 119 to Japanese Patent Application No. 2015-235534, filed Dec. 2, 2015 and Japanese Patent Application No. 2016-207183, filed Oct. 21, 2016. The contents of which are incorporated herein by reference in their entirety.

BACKGROUND OF THE INVENTION

1. Field of the Invention

The present invention relates to a drying apparatus and a conveying system.

2. Description of the Related Art

Inkjet printers that discharge liquid droplets of ink or the like (ink droplets) from nozzles of a liquid discharge head to record images, characters, and the like on recording media such as printing paper are conventionally known. The inkjet printer includes a conveying path for conveying a recording medium as a conveyed object. A plurality of types of inkjet printers are known; examples thereof include serial printers and line printers. The serial printer, in a conveying path, discharges ink while moving a recording head in a main-scanning direction, which is a direction orthogonal to the conveying direction of a conveyed object, and combines conveying operation in a sub-scanning direction, which is the conveying direction of the conveyed object, to execute printing operation on a recording medium. The line printer has a line head in which recording heads are arranged side by side in the main-scanning direction to perform printing in a print width conforming to the width dimension of a recording medium. Printing operation is executed while moving a conveyed object relatively with respect to this line head.

Inkjet printers in recent years finely control the discharge timing of ink droplets and the size of ink droplets to promote the enhancement of printing image quality and the speed of printing operation. However, because of being a system that drops liquid droplets (liquid) onto a recording medium to form an image, as a problem associated with the enhancement of image quality and speed, a problem in which a liquid droplet adhering to the recording medium moves on the surface of the recording medium and mixes with an adjacent liquid droplet is known. In the case of a recording medium having a coat layer or the like in particular, the liquid droplets are difficult to permeate the recording medium, and color mixture with adjacent ink droplets having different colors is likely to occur. If color mixture occurs, a phenomenon of color bleeding, which makes color boundaries blurred, is likely to occur. If color bleeding occurs in a print result, the sharpness of a print image and the like degrade. In other words, image quality degrades.

Owing to the enhancement of the speed of printing operation, if the recording medium is sent to posttreatment of the printing operation with the permeation of ink into the recording medium and the drying of the ink droplets adhering to the recording medium remaining insufficient, problems are likely to occur such as the occurrence of ink transfer (picking) from the recording medium to conveying rollers and the transfer of ink (blocking) between recording media stacked in a conveying path. Examples of known techniques as measures against picking and blocking include applying a powdery material that prevents ink transfer after printing and arranging a drying apparatus in the downstream process of a printing unit to dry ink on the print face of the recording medium.

Among these techniques, a system that arranges a heating roller incorporating a heating source within conveying rollers forming a conveying path is known as the technique of drying ink. The system using the heating roller is a system that brings a recording medium as an object to be dried into contact with the outer peripheral surface of the heating roller while winding the recording medium by an amount equivalent to a certain angle on the outer peripheral surface of the heating roller and heats the recording medium during the contact to dry ink.

The heating roller system heats the ink at about 100° C. to 200° C. at a heating roller part to evaporate not only water but also a solvent. To thus dry the solvent and the water, a necessary amount of heat is required to be supplied within a time during which the heating roller is in contact with a sheet. For this reason, when a recording medium having a high basis weight, which requires a large amount of heat, is used or when the conveying speed of a recording medium is increased, a plurality of heating rollers are required to be used. In this case, the arrangement of the heating rollers is set to a staggered arrangement, whereby apparatus size or sheet operability can be considered.

In a drying apparatus having a plurality of heating rollers arranged in a staggered manner, a solvent and water that have vaporized by the heating rollers arranged below move upward in an ascending air flow within the drying apparatus. In this case, the heating rollers arranged in the upper part are surrounded by an atmosphere of the solvent and the like that have vaporized by the lower heating rollers. Each of the heating rollers is equipped with a guide that guides a recording medium such that the recording medium will be conveyed without departing from a conveying path when the recording medium is loaded or conveyed. The solvent vaporizes as described above from within this guide. The vapor of the solvent can cause problems such as condensation on the guide and rusting the guide.

Apart from the prevention of adherence of solvent vapor to the guide, a technique is known that, in an image forming apparatus including a fixing unit that fixes unfixed toner images on a recording medium at least through heating, prevents water droplets from adhering to the recording medium after fixing (refer to Japanese Unexamined Patent Application Publication No. 2007-187821, for example).

The guide disclosed in Japanese Unexamined Patent Application Publication No. 2007-187821 includes wire members that extend at least in a direction having the component of the conveying direction of the recording medium and have a convex sectional shape protruding in a state having no edge against the conveying path side of the recording medium and a holder that supports the wire members so as to be arranged spaced apart from each other on a face along the conveying path.

The guide installed around a conventional heating roller is in a state in which the guide itself hinders the solvent and the water heated and vaporized by the heating roller from moving above within the apparatus. The outside of the guide is in a state directly receiving the vaporized solvent and the water ascending from around the heating roller arranged immediately therebelow. In this state, the solvent and the water condense on the inside and the outside of the guide owing to a temperature difference between the guide and the vapor.

Even when the wire members as in the guide disclosed in Japanese Unexamined Patent Application Publication No.

2007-187821 are used, a drying apparatus that supplies a necessary amount of heat for the heating roller used for the purpose of drying a continuous form normally installs a guide that covers a part in which a recording medium is wound around a conveying roller including the heating roller. When the continuous form is wound around the heating roller, humid air containing a vaporized solvent and water is inevitably generated from the winding part. This humid air is required to be exhausted from a drying chamber in which the winding part and the heating roller are installed.

In this case, if there is a conveying path through which the recording medium passes in a direction to which the humid air moves, the humid air generated below the conveying path adheres to the recording medium that again passes through the upper conveying path, thereby causing water droplets. In this case, even when the guide is formed of the wire members to attempt to exclude the humid air efficiently from the winding part, the attempt will not lead to a solution.

SUMMARY OF THE INVENTION

According to one aspect of the present invention, a drying apparatus includes a plurality of rollers and an exhaust unit. The plurality of rollers include at least one heating roller and are arranged to form a conveying path where a conveyed object is wound to be heated and conveyed. The exhaust unit is located above the conveying path. The plurality of rollers are arranged such that a first subset of rollers amongst the plurality of rollers is arranged on one side in a horizontal direction, and a second subset of rollers is arranged on an opposite side in the horizontal direction. The conveyed object is conveyed along the conveying path windingly back and forth between the first side and the second side, such that the winding conveyance back and forth between the first side and the second side advances the conveyed object upwardly or downwardly in a vertical direction. For example (FIGS. 1, 8 and 9), the conveying path includes plural horizontal sections, one disposed above another, and amongst the plural horizontal sections, each horizontal section is shorter than the horizontal sections below the horizontal section.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
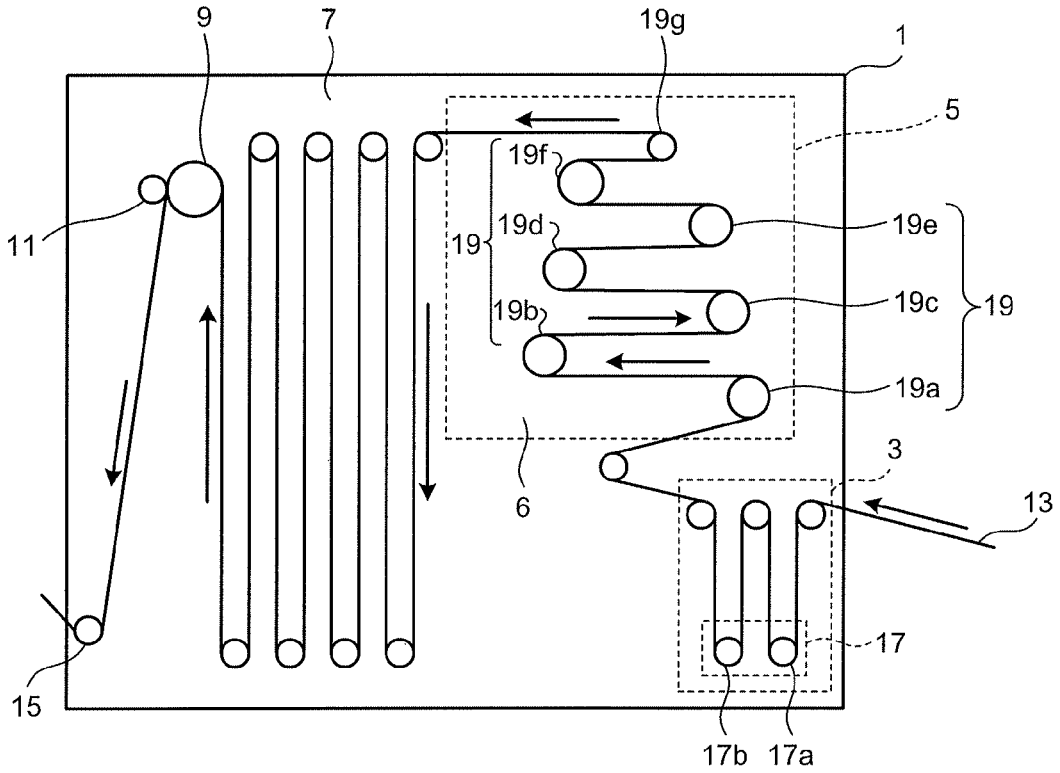
FIG. 1 is a view of an overall configuration of a drying apparatus according an embodiment of the present invention.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

The present invention relates to a drying apparatus that dries a conveyed object while conveying the conveyed object. An embodiment described below exemplifies a continuous, long sheet-shaped member as the conveyed object. Consequently, the drying apparatus in the present embodiment continuously conveys the conveyed object along a conveying path formed therewithin. The drying apparatus according to the present invention, in a conveying path formed by conveying members arranged with certain arrangement, includes heating units in the conveying members. Using heat from the heating, units, the conveyed object is conveyed while being heated. Consequently, the conveyed object is not limited to a continuous one so long as the conveyed object is conveyed by the conveying members while being heated, and the present invention can also be applied to a sheet-shaped member formed having a certain length.

The conveying path that the drying apparatus according to the present invention includes is formed by arranging a plurality of conveying rollers as the conveying members. Part or the whole of these conveying members are heating conveying rollers including the heating units. The drying apparatus according to the present invention, in a conveying path as a drying process for the conveyed object, can prevent humid air generated around a heating conveying roller from adhering to another heating conveying roller or other surrounding parts and can exhaust the humid air efficiently as one of the essences.

The following describes embodiments of the present invention with reference to the accompanying drawings.

An embodiment has an object to prevent condensation occurring on the recording medium or the guide in the conveying path caused by the vaporization of the solvent or the water from the recording medium in the conveying path.

FIG. 1 is a view of an overall configuration of a drying apparatus 1 according to the present embodiment. As illustrated in FIG. 1, the drying apparatus 1 includes, as the basic internal configuration, a buffer 3, a drying unit 5, a cooling unit 7, a conveying roller 9, and a nip roller 11. These components form the conveying path of a recording medium 13 within the drying apparatus 1. The recording medium 13 is an example of the conveyed object and is a long sheet-shaped member. The recording medium 13 is what is called a continuous form. The recording medium 13 is conveyed mainly by the rotational drive of the conveying roller 9 arranged downstream in the conveying path in the drying apparatus 1. In the drying apparatus 1 illustrated in FIG. 1, the recording medium 13 is conveyed from the buffer 3 arranged upstream in the lower part (the right part on the drawing in FIG. 1) toward a paper ejection guide roller 15 arranged downstream in the lower part (the left part on the drawing in FIG. 1). In other words, in FIG. 1, the recording medium 13 enters the interior of the drying apparatus 1 from the lower right and leaves the interior from the lower left. The conveying path is thus formed so as to convey the recording medium 13 in a certain direction. The rollers other than the conveying roller 9 may be idler rollers having no drive source or rollers having drive sources.

The buffer 3 is provided at the entrance to the drying apparatus 1. The buffer 3 adjusts the conveyance buffer amount of the recording medium 13 when the recording medium 13 is conveyed. The conveyance buffer amount in the buffer 3 is adjusted by the control of the rotational speed of the conveying roller 9. In other words, by controlling the rotational speed of the conveying roller 9, a state in which the conveyance speed of the recording medium 13 is maintained at a constant speed can be formed. The buffer 3 includes a movable member 17 including two buffer rollers, that is, a first buffer roller 17*a* and a second buffer roller 17*b* that are arranged in a vertically movable manner. The conveyance buffer amount is changed by the vertical position of this movable member 17.

The drying unit 5 is positioned downstream of the buffer 3. The recording medium 13 that has passed through the buffer 3 enters the drying unit 5. The area occupied by the drying unit 5 is a closed space by a chamber 6. The chamber 6 is insulated from the environment by an insulating material. For this reason, the space within the chamber 6 of the drying unit 5 is higher in temperature than the environment. In this space, heating rollers 19 which are a plurality of conveying members, are arranged.

Part of the heating rollers 19 forming the conveying path may be a conveying roller having no heating unit. The space within the chamber 6 is heated by heat emitted by the heating rollers 19. Consequently, an exclusive space heating apparatus is unnecessary in the drying unit 5. Each of the heating rollers 19 includes a heating element such as a halogen lamp and is configured such that the heat of this heating element will be transferred to the outer periphery of the roller.

The chamber 6 of the drying unit 5 arranges a plurality of heating rollers 19. As illustrated in FIG. 1, for example, the heating rollers 19 including a first heating roller 19*a*, a second heating roller 19*b*, a third heating roller 19*c*, a fourth heating roller 19*d*, a fifth heating roller 19*e*, a sixth heating roller 19*f*, and a seventh heating roller 19*g* are arranged with certain arrangement. The arrangement of these heating rollers 19 when viewed from the side in the conveying direction of the recording medium 13 is staggered arrangement as illustrated in FIG. 1.

As illustrated in FIG. 1, the conveying path of the recording medium 13 is formed so as to direct the recording medium 13 from the upstream to the downstream in the conveying path while turning back the conveying direction of the recording medium 13 by substantially 180 degrees with appropriate lengths to reverse the direction. In other words, the heating rollers 19 are arranged at the positions where the conveying direction of the recording medium 13 in the conveying path turns back. In the description of the present embodiment, when the heating rollers 19 exemplified above are described without discriminating the heating rollers 19 from each other, the heating rollers 19 are simply referred to as a "heating roller 19."

The following describes the conveying path formed within the drying unit 5. As illustrated in FIG. 1, the recording medium 13 that has entered the drying unit 5 from the buffer 3 is wound around the outer periphery of the first heating roller 19*a* to be conveyed in the horizontal direction. Next, the recording medium 13 is wound around the outer periphery of the second heating roller 19*b*, which is arranged in the horizontal direction of the first heating roller 19*a* and closer to the internal of the drying unit 5, and is conveyed with the conveying direction turned back in a traveling direction opposite to the previous traveling direction. When passing through this second heating roller 19*b*, the recording medium 13 moves upward in the vertical direction of the conveying path. Next, the recording medium 13 is wound around the outside of the third heating roller 19*c*, which is arranged in the horizontal direction of the second heating roller 19*b* and closer to the exterior of the drying unit 5, and is again conveyed in the horizontal direction toward the interior of the drying unit 5.

The recording medium 13 is then conveyed downstream while repeating turned-back conveyance in the horizontal direction. As described above, the conveying path formed within the drying unit 5 is formed so as to repeat the movement in the horizontal direction of the recording medium 13 by the heating rollers 19 and the movement in the vertical direction while turning back the movement in the horizontal direction.

The recording medium 13 is conveyed while being in contact with the heating rollers 19 forming the conveying path, and the recording medium 13 is dried by the heat from the heating rollers 19.

Figure 10:
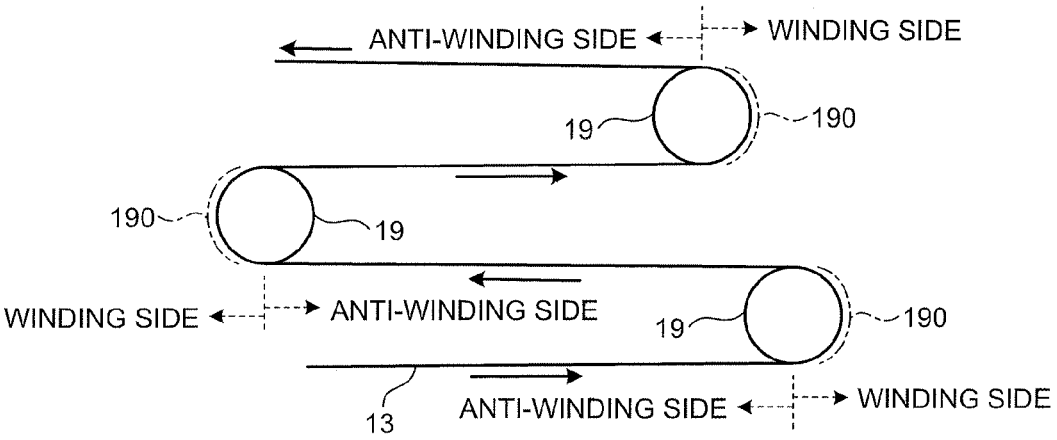
FIG. 10 is a view defining terms for use in the explanation of the arrangement of rollers according to the present embodiment.

The following describes the arrangement of the heating rollers 19 forming the conveying path of the recording medium 13 in more detail. In the following description, the representation "the winding side or the anti-winding side of the recording medium 13" is used in the description of the positions of the heating roller 19. The following first describes "the winding side of the recording medium 13" and "the anti-winding side of the recording medium 13." FIG. 10 is an enlarged view of part of the conveying path formed by the arrangement of the heating rollers 19. As illustrated in FIG. 10, a part that is on the outer periphery of the heating roller 19 and at which the recording medium 13 is in contact with the heating roller 19 to change the conveying direction is defined as a "winding part 190." As to the conveying direction of the recording medium 13, the conveying direction in the horizontal direction is turned back to the opposite direction with the winding part 190 as a base point. In this winding part 190, a side with which the recording medium 13 is in contact on the outer periphery of the heating roller 19 is defined as a "winding side." The side opposite to the winding side is defined as an "anti-winding side." In this process, the recording medium 13 is moved in a height direction corresponding to at least the diameter of the heating roller 19.

As already described, the heating rollers 19 forming the conveying path are arranged in a multi-stage manner spaced in the vertical direction from the upstream to the downstream in the conveying direction of the recording medium 13 (refer to FIG. 1). In other words, when it is assumed that a pair of heating rollers 19 arranged at positions turning back the conveying direction of the recording medium 13 are one stage, these pairs in the horizontal directions are arranged in a multi-stage manner within the drying unit 5. As to the heating rollers 19 on the respective stages, the arrangement of at least one is adjusted such that overlap in the vertical direction with the heating roller 19 on another stage in the vertical direction will be less.

As illustrated in FIG. 1, for example, taking the positions of the first heating roller 19*a* arranged most upstream and the third heating roller 19*c* arranged thereabove as an example, in the horizontal direction of the conveying path formed thereby, the arrangement of the first heating roller 19*a* and the third heating roller 19*c* is adjusted so as to be at different positions.

Figure 9:
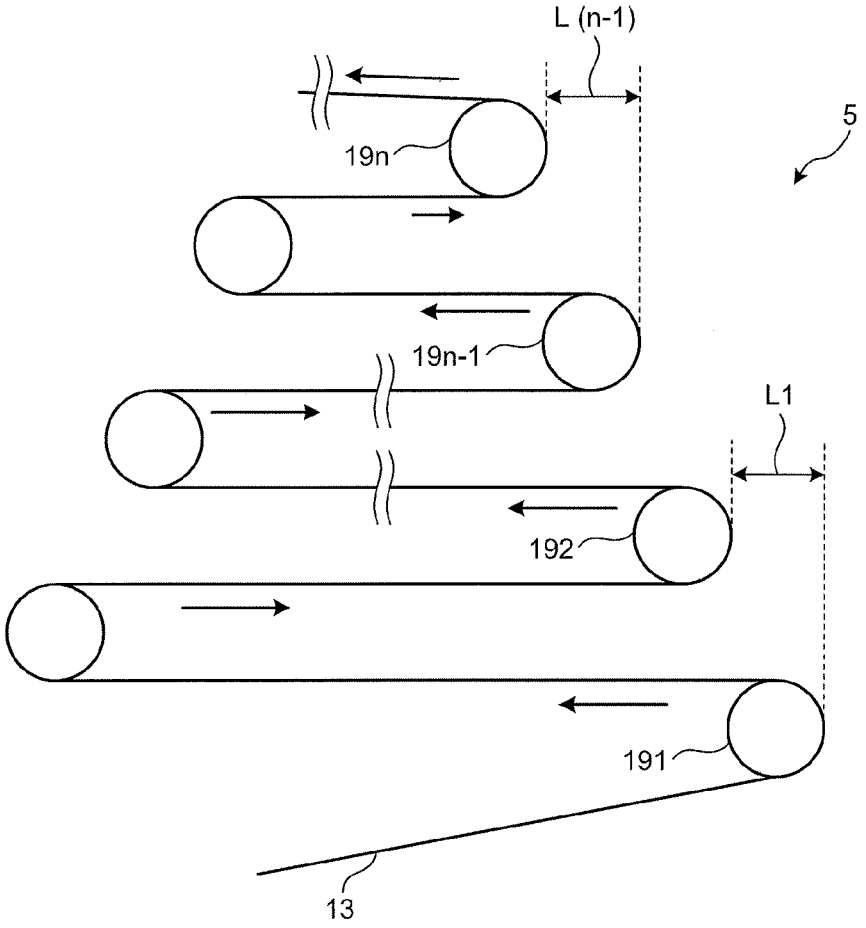
FIG. 9 is view explaining an example of a roller arrangement in the drying apparatus according to the present invention.

The following describes the arrangement relation of the heating rollers 19 in the conveying path in more detail with reference to FIG. 9. FIG. 9 illustrates only the arrangement relation of the heating rollers 19 in the drying unit 5. In FIG. 9, among the heating rollers 19, the one arranged most upstream is defined as a "first roller 191." The heating roller 19 arranged downstream of the first roller 191 and immediately above the first roller 191 is defined as a "second roller 192." Similarly, the one arranged most downstream in the conveying path is defined as an "nth roller 19*n*." The letter n is an integer of 2 or more.

In FIG. 9, focusing on the positional relation between the first roller 191 and the second roller 192, the first roller 191 and the second roller 192 are arranged such that the vertical tangential lines thereof on the winding side of the recording medium 13 will be positioned not to overlap each other in the vertical direction of the conveying path. In FIG. 9, the vertical tangential line on the winding side, of the second roller 192 is displaced relative to the vertical tangential line on the winding side, of the first roller 191 by a distance equivalent to L1 in the horizontal direction.

Similarly, as to the nth roller 19*n* and an (n−1)th roller 19(*n*−1) arranged downstream and below the nth roller 19*n* and in the stage one stage before the nth roller 19*n* are arranged such that, the respective vertical tangential lines on the winding side do not overlap each other, and the vertical tangential line of the nth roller 19*n* is displaced from the vertical tangential line of the (n−1)th roller 19(*n*−1) by a distance equivalent to L(n−1).

In other words, the conveying path formed within the drying unit 5 is formed such that the heating rollers 19 are arranged at the positions where the conveyance of the recording medium 13 in the horizontal direction is turned back, and the recording medium 13 is conveyed from the upstream to the downstream. The conveying path is formed such that the recording medium 13 will move upward in the vertical direction each time the recording medium 13 is turned back by the heating roller 19. The heating rollers 19 arranged above and below in the vertical direction in the conveying path are arranged at the positions in which the vertical tangential lines thereof on the winding side of the recording medium 13 do not overlap each other.

To put it still another way, the heating rollers 19 are arranged in such a manner that, when the drying unit 5 is viewed from above, the heating rollers located below in the vertical direction of the conveying path are arranged at the positions nearer to the center of the chamber 6 than the heating rollers located above in the vertical direction as relative positions.

As described above, the heating rollers 19 forming the conveying path are arranged such that the end faces on the winding sides of the recording medium 13, of the heating rollers 19 arranged at positions at the same side will be differently positioned in the vertical direction directed from the upstream in the conveying direction to the downstream in the conveying direction. With one heating roller 19 arranged in the conveying path as a base point, the other heating rollers 19 that are arranged downstream and in the vertical direction of the one heating roller 19 at the same side are arranged at positions displaced in the direction toward the anti-winding side in the one heating roller 19. The other heating rollers 19 that are arranged upstream of the one heating roller 19 and at the same side in the vertical direction are arranged at positions displaced outside in the horizontal direction than the winding side of the one heating roller.

To put still another way with reference to FIG. 1 and FIG. 9, the conveying path formed within the drying unit 5 is formed so as to move the recording medium 13 in the vertical direction while turning the recording medium 13 back in the horizontal direction. The turning back in the horizontal direction of the recording medium 13 is performed by winding the recording medium 13 around the outer periphery of the heating rollers 19. The length of conveyance in the horizontal direction of the recording medium 13 becomes shorter as the conveying path is directed in the vertical direction. In other words, the conveyance length in the horizontal direction of the recording medium 13 is longer in the upstream than in the downstream. This is because the heating rollers 19 are displaced such that the vertical tangential lines indicating the positions of the side faces on the winding side of the recording medium 13, of the heating rollers 19 located downstream and upstream does not overlap each other. As to the heating rollers 19 at the positions where the recording medium 13 is turned back in the same direction in the horizontal direction, the heating roller 19 arranged upstream is positioned outside than the heating roller 19 arranged downstream in the inner space of the drying unit 5.

As described above, the heating rollers 19 are arranged such that positions of the end faces on the winding sides of the facing heating rollers 19 located in the vertical direction and upstream and downstream in the conveying path will be positioned not to overlap each other. Owing to this arrangement of the heating rollers 19, when humid air generated in the heating rollers 19 located downstream in the conveying path ascends in the space within the chamber 6, the humid air will not be in contact with (not hit) the upper heating rollers 19 and is exhausted to the outside of the chamber 6. With this process, condensation on the heating rollers 19 can be prevented from occurring.

The embodiment described above exemplifies a case in which all the rollers are the heating rollers 19 but is not limited thereto; at least one roller may be the heating roller 19. It is assumed that one roller is the heating roller 19 and that this heating roller 19 is arranged in the vertical direction in between the first roller 191 and the nth roller 19*n*.

In this case, the heating roller 19 is arranged such that the vertical tangential line on the winding side of the recording medium 13 is at a position displaced relative to the vertical tangential line on the winding side, of a next roller arranged on the winding side, in the horizontal direction toward the winding side. With this arrangement, when humid air generated in the heating roller 19 located below in the vertical direction of the conveying path ascends in the space within the chamber 6, the humid air will not be in contact with (not hit) the next heating roller 19 located above in the vertical direction of the conveying path and is exhausted to the outside of the chamber 6. Consequently, an effect similar to the already described effect can be achieved.

Also when there are a plurality of heating rollers 19, the vertical tangential line on the winding side, of each heating roller 19 located below another roller in the vertical direction of the conveying path is arranged so as to be at a position displaced toward the winding side in the horizontal direction relative to the vertical tangential line on the winding side, of the roller arranged next in the vertical direction (the next heating roller 19 or the conveying roller).

When rollers with a heating function and rollers without the heating function are arranged in a mixed manner as described above, the next roller is arranged such that the vertical tangential line on the winding side, of the next roller is at a position displaced toward the winding side in the horizontal direction at least relative to the heating roller 19 arranged below the next roller in the vertical direction of the conveying path.

In the space among the heating rollers 19, drying is performed by the convectional heat transfer of high-temperature air. The heating roller 19 located more upstream requires higher heating capability. This is because heat by the heating roller 19 located upstream is taken away not by ink but by the recording medium 13 as a base, and the heat is used for the ink after the temperature of the recording medium 13 becomes a certain temperature or more.

Given these circumstances, as to the heating rollers 19 illustrated in FIG. 1, the two heating rollers 19 located upstream, that is, the first heating roller 19*a* and the second heating roller 19*b* are for increasing the temperature of the recording medium 13, and these rollers have capability of heating with enough heat capacity to increase the temperature of the recording medium 13.

Drying conditions vary depending on the basis weight of the recording medium 13, a print area and a print density, and temperature and humidity within the chamber 6, and the heating capability of the heating rollers 19 is set in accordance with the basis weight and the like.

The drying apparatus 1 includes an approaching-and-separating mechanism 199 that enables the positions of the end faces on the winding sides in the horizontal direction of the heating rollers 19 to move. This approaching-and-separating mechanism 199 is an interval changing mechanism that changes the intervals between the positions of the end faces on the winding sides of the heating rollers 19 in a facing relation in the horizontal direction of the heating rollers 19 arranged in pairs in the horizontal direction of the conveying path of the recording medium 13. By this approaching-and-separating mechanism 199, the heating rollers 19 can be adjusted so as to be arranged not to overlap each other in the vertical direction as described above.

Figure 7:
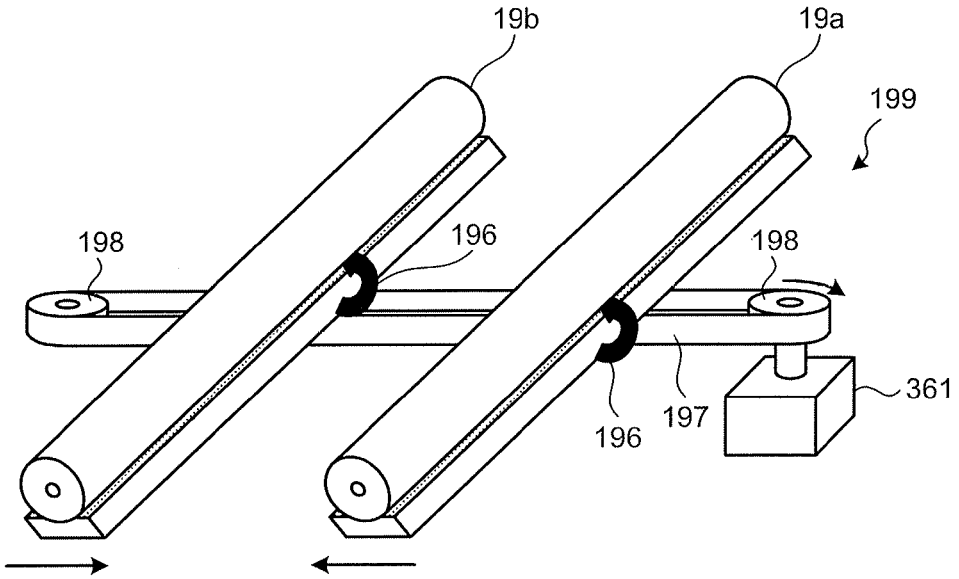
FIG. 7 is a perspective view of an example of an-approaching-and-separating mechanism that the drying apparatus according to the present embodiment includes.

The following describes the structure of the approaching-and-separating mechanism 199 with reference to FIG. 7. The approaching-and-separating mechanism 199 is provided for each of the heating rollers 19 forming the conveying path. A pair of heating rollers 19 are coupled to a moving belt 197 stretched between a pair of rotary drive pulleys 198 with coupling metal fittings 196 to construct the approaching-and-separating mechanism 199. By rotary driving one of the rotary drive pulleys 198 by a horizontally moving motor 361, the heating rollers 19 corresponding to each other coupled to the moving belt 197 move in a mutually approaching direction and a separating direction.

When the rotary drive pulley 198 is driven clockwise on the drawing by the horizontally moving motor 361 as illustrated in FIG. 7, for example, the first heating roller 19*a* and the second heating roller 19*b* move in a mutually approaching direction. Naturally, when the rotational direction of the horizontally moving motor 361 is changed to counterclockwise on the drawing, the first heating roller 19*a* and the second heating roller 19*b* move in a mutually separating direction.

The moving amount of the heating roller 19 is set by a microcomputer unit 30 (FIG. 3) described below, and the microcomputer unit 30 controls the drive of the horizontally moving motor 361 to perform the setting. The first heating roller 19*a* and the second heating roller 19*b*, which are on the lowermost stage, may be fixed while controlling the intervals in the horizontal direction of the heating rollers 19 thereabove. The latter case can eliminate one drive mechanism and is advantageous in terms of costs.

The description returns to FIG. 1. The recording medium 13 that has exited the drying unit 5 is conveyed to a cooling unit 7 including eight guide rollers arranged in a staggered manner in the vertical direction. The recording medium 13 is conveyed through these guide rollers and thereby cooled. In this space (the cooling unit 7), the temperature of the recording medium 13 can be controlled by the blowing of outside air and the changing of a conveying distance. The changing of the conveying distance is performed by changing the positions in the up-and-down direction of the lower four guide rollers relatively with respect to the upper four guide rollers, for example.

Figure 2:
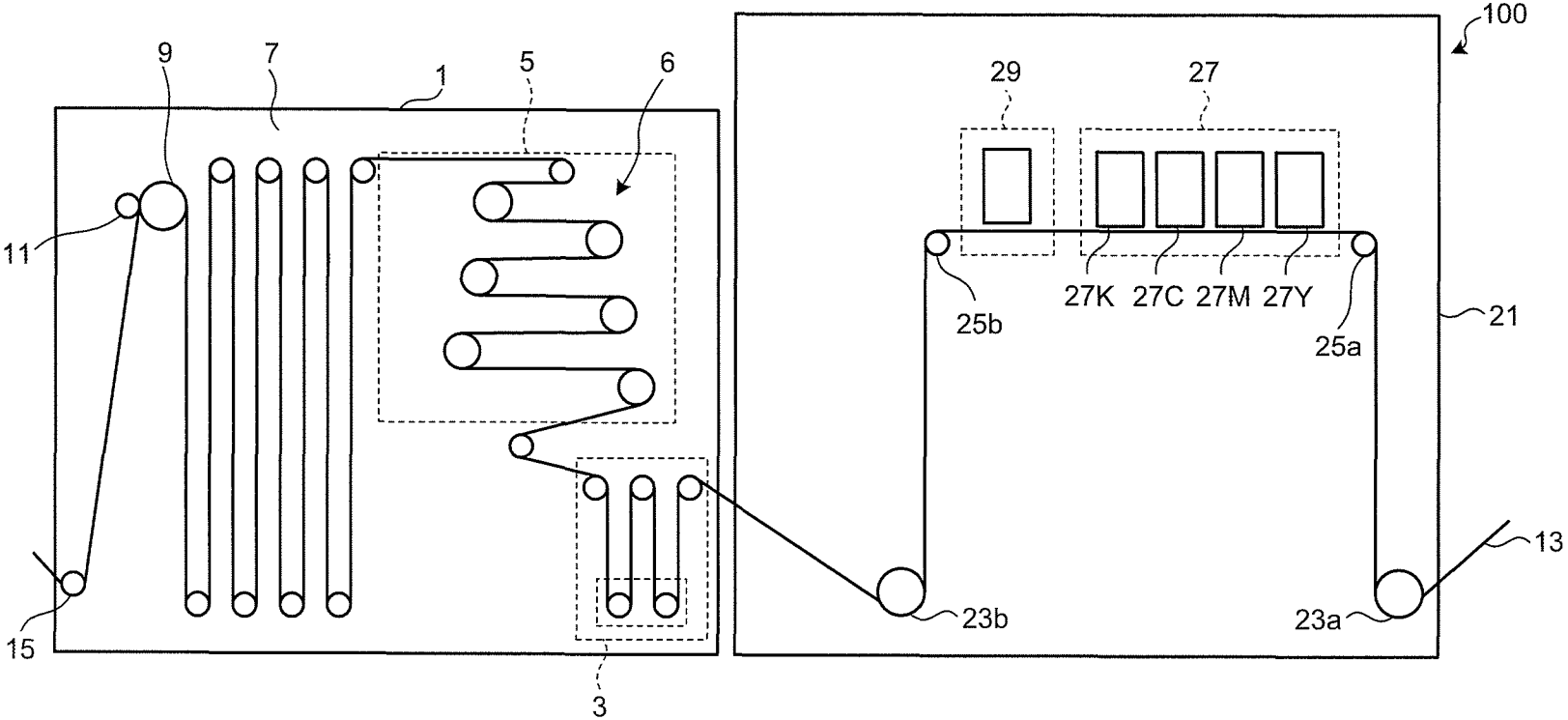
FIG. 2 is a view of a configuration of a conveying system according to the embodiment of the present invention in which the drying apparatus is arranged downstream of a printing apparatus.

FIG. 2 is a view of a configuration of a conveying system 100 in which the drying apparatus 1 is arranged downstream of a printing apparatus 21.

In the conveying system 100 illustrated in FIG. 2, the recording medium 13 that has entered the printing apparatus 21 is fed to a printing unit 27 via a first conveying roller 23*a* and a first guide roller 25*a*. The printing unit 27 includes inkjet heads 27Y, 27M, 27C, and 27K that discharge each ink of Y, M, C, and K, respectively. The gap between these inkjet heads 27Y, 27M, 27C, and 27K and a sheet is about 1 to 2 mm. The recording medium 13 that has passed through the printing unit 27 is guided to the drying apparatus 1 via a second guide roller 25*b* and a second conveying roller 23*b* located downstream.

The printing apparatus 21 includes a print face drying unit 29 downstream of the printing unit 27. This unit is for preventing ink transfer (picking) when the ink discharged onto the print face is in contact with various kinds of rollers and not for preventing blocking. Picking occurs in such an undried state that even short-time contact causes ink transfer. Blocking is a phenomenon in which although ink is dried to such an extent that picking does not occur, ink adheres to parts other than the print face by the application of high pressure to the print face (the face to which ink adheres) of the recording medium 13 when the recording medium 13 is stacked, when the recording medium 13 is wound, or the like.

As to the division of roles between the printing apparatus 21 and the drying apparatus 1 in the conveying system 100 according to the present embodiment, picking is prevented within the printing apparatus 21, whereas blocking is prevented by the drying apparatus 1.

Figure 3:
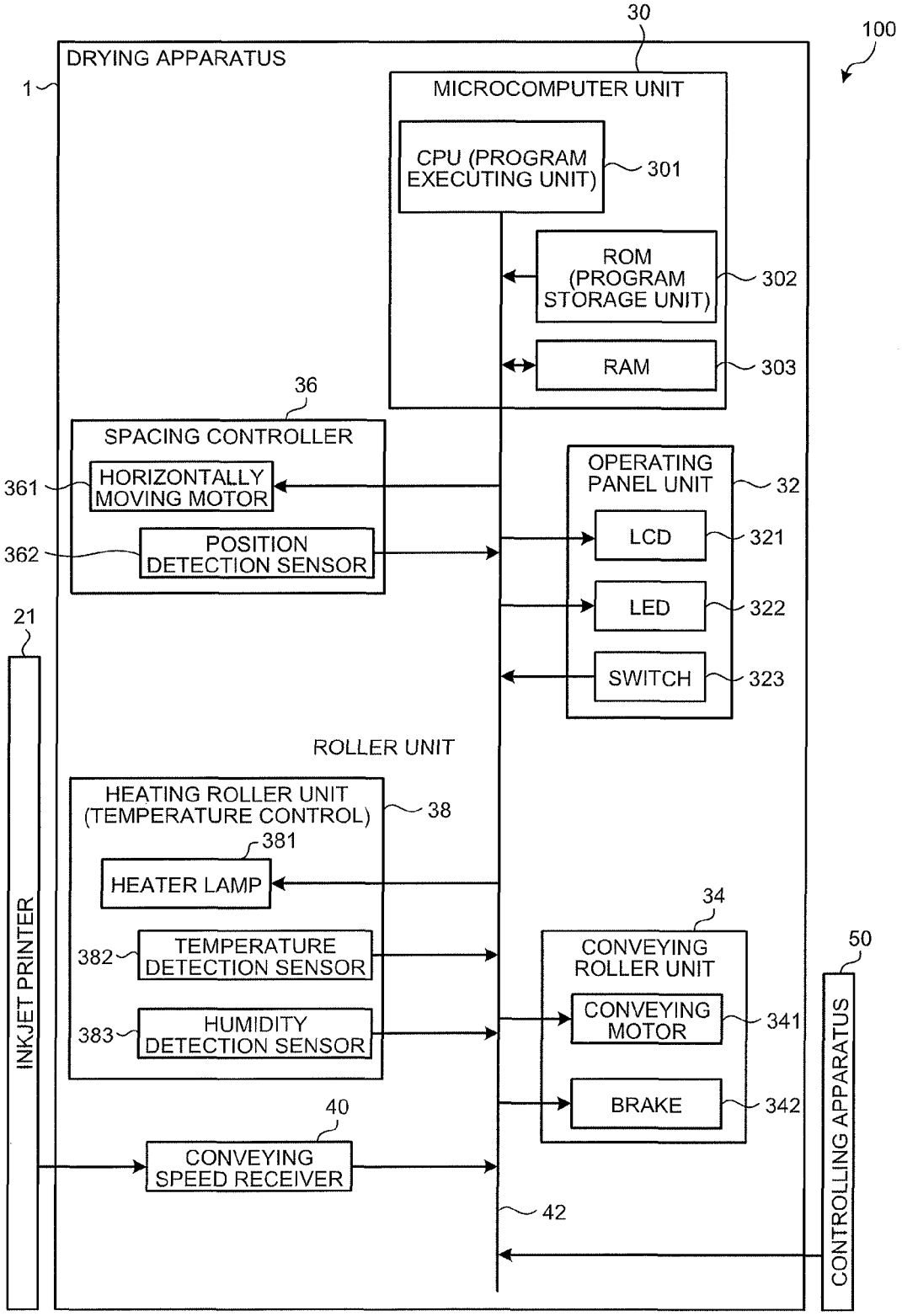
FIG. 3 is a block diagram of a control configuration according to an embodiment of the conveying system.

FIG. 3 is a block diagram of a control configuration of the conveying system 100 according to FIG. 2. The symbols are given so as to correspond to the mechanical configuration in FIG. 2.

In FIG. 3, the drying apparatus 1 includes the microcomputer unit 30 that controls devices, an operating panel unit 32 that an operator operates, a conveying roller unit 34 (the conveying roller 9 and the nip roller 11), an interval controller 36, a heating roller unit 38, and a conveying speed receiver 40, in which the respective devices and sensors of these units are connected to each other via an I/O interface by a bus 42.

The microcomputer unit 30 that functions as a conveyance controller includes a central processing unit (CPU) 301 that instructs the control of the device units of the drying apparatus 1 and performs computations required for the control, a read-only (ROM) 302 that stores therein a computer program executed by the CPU 301, and a random access memory (RAM) 303 that temporarily stores therein computation results.

The operating panel unit 32 includes a liquid crystal display (LCD) 321 that displays information such as the state of the drying apparatus 1, menu items being operated by the operator, or the set temperature of the heating rollers 19, a light-emitting diode (LED) 322 that changes the lighting or blinking pattern in accordance with the state of the drying apparatus 1 and notifies the operator of the state of the drying apparatus 1, and a switch 323 for the operator to operate the drying apparatus 1.

The conveying roller unit 34 controls a conveying motor 341 that rotary drives the heating rollers 19 and a brake 342. The drying apparatus 1 and the printing apparatus 21, and the drying apparatus 1 and a controlling apparatus 50 of the conveying system 100 are connected to each other via respective I/F cables; information on the conveying speed of the recording medium 13 is transmitted from the printing apparatus 21 to the drying apparatus 1 via the I/F cable. The information on the conveying speed is converted into speed data in the form used to control the conveying motor 341 of the heating rollers 19 by the conveying speed receiver 40 and is used for the speed control of the conveying roller unit 34. From the controlling apparatus 50, the basis weight of the recording medium 13 to be printed and print area and print density information are transmitted, which are used for the interval control of the heating rollers 19.

The interval controller 36 includes the horizontally moving motor 361 and a plurality of position detection sensors 362. The position detection sensors 362 detect the respective positions of the heating rollers 19 and inform the microcomputer unit 30. The microcomputer unit 30 drive controls the horizontally moving motor 361 based on the respective positions of the heating rollers 19, the basis weight of the recording medium 13, the print area, the print density, and the temperature and the humidity within the chamber 6. By the drive control of the horizontally moving motor 361 by the microcomputer unit 30, the distance of the rotational center of the heating rollers 19 in the facing relation in the horizontal direction is adjusted. In other words, the microcomputer unit 30 adjusts the arrangement of the heating rollers 19. The horizontally moving motor 361 is configured to control the heating roller 19 independently in each pair of heating rollers 19 in the facing relation.

The heating roller unit 38 includes a heater lamp 381, a temperature detection sensor 382, and a humidity detection sensor 383. The temperature detection sensor 382 detects the temperature of each of the heating rollers 19 and the temperature of a preset location within the chamber 6, whereas the humidity detection sensor 383 detects the humidity of a preset location, or the humidity of the upper part of the chamber 6, for example, which are sent to the microcomputer unit 30.

The microcomputer unit 30 controls the lighting of the heater lamp 381 based on the sent temperature. The microcomputer unit 30 calculates an appropriate, interval in the horizontal direction of the conveying path in each of the heating rollers 19 based on parameters sent from the controlling apparatus 50 of a printing system that the conveying system 100 including the printing apparatus 21 includes. The parameters are the basis weight of the recording medium 13, print area and print density information, and temperature information and humidity information within the chamber 6. The horizontally moving motor 361 is driven based on the calculated intervals to move the heating rollers 19 to the positions at the appropriate interval for each of the heating rollers 19.

The position of the end face on the winding side of the heating roller 19 is calculated and set based on a data table that is obtained by parameterizing relation among the basis weight of the recording medium 13, the print area, the print density, the conveying speed, and the temperature and the humidity within the chamber 6 using an actual apparatus in advance. This data table is stored in the RAM 303. The microcomputer unit 30 refers to the data table stored in the RAM 303 based on a computer program that controls the positions of the heating rollers 19 and calculates a change condition corresponding to a change in the parameters such as the basis weight of the recording medium 13. The microcomputer unit 30 executes processing to set the position of the end face on the winding side of the heating roller 19 based on this change condition. As a result of this processing, the drying apparatus 1 sets the positions of the heating rollers 19 such that the interval in the horizontal direction of the heating rollers 19 will be appropriate in accordance with the progress of print processing on the recording medium 13. As described above, the drying apparatus 1 according to the present embodiment can control the drying unit 5 without causing picking and blocking.

The following describes an example of the data table as the change condition for use in the setting of the position of the end face on the winding side of the heating roller 19 with reference to the following Table 1.

TABLE 1

| | Level | | | | |
|---|---|---|---|---|---|
| | 1 | 2 | 3 | 4 | 5 |
| Print area | Small | ← | | → | Large |
| Print density | Small | | | | Large |
| Print speed | Small | | | | Large |
| Sheet basis weight | Small | | | | Large |
| Roller temperature | Low | | | | High |
| Chamber temperature and humidity | Low | | | | High |

"Level" in Table 1 is a parameter for setting the position of the end face on the winding side of the heating roller 19. As the number based on this level is larger, the interval between the positions of the end faces on the winding side at the downstream in the conveying direction in the arrangement of the heating rollers 19 is wider. In other words, as the number based on the level is larger, the overlap in the vertical direction between the heating roller 19 located upstream in the conveying direction and the heating roller 19 located downstream in the conveying direction in the arrangement of the heating rollers 19 is smaller. With this configuration, the upward flow of the humid air generated in the heating rollers 19 can be made efficient.

In Table 1, when the position of the end faces on the winding sides (hereinafter, referred to as a "roller end face positions") of the conveyed object in the horizontal direction of the heating rollers 19 by the print area is changed, for example, the print area is divided into five levels; a case of the largest print area is set to "5," whereas a case of the smallest print area is set to "1." In other words, the roller end face positions when the print area is the largest are set such that the interval between positions of the end faces at the downstream in the conveying direction is wider, the overlap between the heating rollers 19 in the vertical direction in the serpentine conveying path is smaller, and the upward flow of the humid air is improved. This is because a larger print area causes a larger amount of ink accordingly and causes a larger amount of humid air during drying.

Similarly, the print density is also divided into five levels; a case of the highest print density is set to "5;" whereas a case of the lowest print density is set to "1." The arrangement of the heating rollers 19 corresponding to each number is similar to the case of the print area. In other words, the roller end face positions when the print density is the highest are set such that the interval between the positions of the end faces at the downstream in the conveying direction is wider, the overlap between the heating rollers 19 in the vertical direction in the conveying path is smaller, and the upward flow of the humid air is improved. This is because a higher print density causes a larger amount of ink accordingly and causes a larger amount of humid air during drying.

Similarly, the print speed is also divided into five levels; a case of the highest print speed is set to "5," whereas a case of the lowest print speed is set to "1." The arrangement of the heating rollers 19 corresponding to each number is similar to the cases of the print area and the print density. In other words, the roller end face positions when the print speed is the highest are set such that the interval between the positions of the end faces at the downstream in the conveying direction is wider, and the overlap between the heating rollers 19 in the vertical direction in the conveying path is smaller, and the upward flow of the humid air is improved. This is because a higher print speed causes a larger amount of processing per unit time accordingly and causes a larger amount of humid air during drying.

Similarly, the sheet basis weight, the temperature of the heating roller 19 (roller temperature), the internal temperature and humidity of the chamber 6 (chamber temperature and humidity) are also divided into five levels. The arrangement of the heating rollers 19 corresponding to each number is similar to the cases of the print area and the print density. This is because a larger sheet basis weight causes a higher water content in the recording medium 13 accordingly and causes a larger amount of humid air during drying. In addition, this is because a higher roller temperature as the temperature of the heating rollers 19 causes a larger amount of humid air during drying accordingly, and a higher chamber temperature and humidity causes a larger amount of humid air during drying accordingly.

The levels of a plurality of parameters may be combined to set the roller end face positions. When the print area and the print density are combined, for example, the maximum value of the number indicating the level is "10." Consequently, the interval between the maximum value and the minimum value of the physical distance of the interval between the rollers is divided for setting, and the roller end face positions corresponding to the sum total of the parameters is set. In this case, the parameter for use in the setting of the roller end face positions is between "2" and "10." Furthermore, all the parameters set in the data table may be used to set the roll end face position. In this case, the maximum value of the number for determining the level is "30," whereas the minimum value thereof is 6. In other words, dividing into 24 levels from Level "6" to Level "30," the roller end face positions may be set.

Although the levels of the respective parameters set in the data table in the present embodiment are set to 1 to 5, weighting may be assigned to the levels of a specific parameter. When weighting is assigned to the print area, for example, the maximum value of the print area may be 10 with the maximum value of the level for the other items remaining to be 5. Furthermore, the combination with the other items as described above may be performed.

Figure 4:
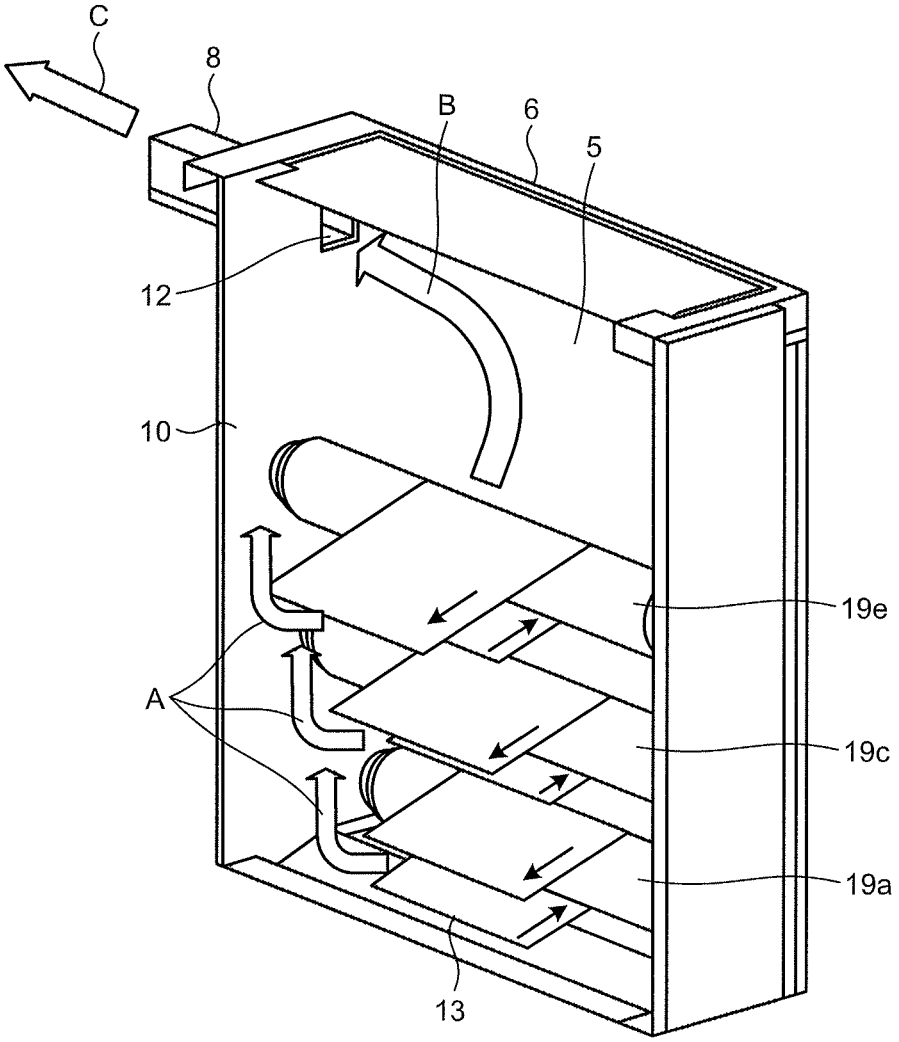
FIG. 4 is an explanatory sectional view of a chamber of a drying unit of the drying apparatus according to FIG. 1 at the center to exemplify an airflow of the drying unit.

FIG. 4 is a sectional view of the chamber 6 of the drying unit 5 including the heating rollers 19 at the center. The following describes an airflow in the drying unit 5 with reference to FIG. 4. The temperature of the heating roller 19 is controlled to a set temperature by a noncontact temperature detection sensor (a thermopile or the like) 382 and is thereby not overheated. For the same reason, faulty drying owing to insufficient heating does not occur.

The ink printed on the recording medium 13 by the printing unit 27 is heated by the heating rollers 19 and becomes gas, which is exhausted to the outside of the chamber 6 (in a direction of the arrow C) through an exhaust duct 8 as an exhaust unit connected to the upper part of a rear wall 10 of the chamber 6 of the drying unit 5. In this process, an exhaust fan may be attached to the exhaust duct 8, or an external suction apparatus or the like may be connected thereto.

As described above, the heating rollers 19 are arranged in a staggered manner in the horizontal direction and are further arranged gradually inwardly so as not to overlap each other in the up-and-down direction. An exhaust port 12 to which the exhaust duct 8 is connected is arranged at the upper part of the rear wall 10 of the chamber 6. Vapor does not straightforwardly ascend, flows toward the rear wall 10 of the drying unit 5 through the recording medium 13 adjacent in the up-and-down direction conveyed in the staggered directions (in a direction of the arrows A), and then ascends to be directed to the exhaust port 12 (in a direction of the arrow B).

As already described, the heating rollers 19 are arranged in a staggered manner so as not to overlap the other heating rollers 19 in the up-and-down direction. Furthermore, the heating rollers 19 in an up-and-down relation do not overlap each other such that the intervals between the positions of the end faces on the winding sides of the heating rollers 19 arranged in a multi-stage manner in the up-and-down direction will gradually narrow from the upstream to the downstream in the conveying direction of the recording medium 13. With this arrangement, even when the humid air generated in the lower heating rollers 19 ascends, the humid air will not hit the heating roller 19 immediately thereabove, whereby condensation on a loading guide 20 and the recording medium 13 can be prevented from occurring.

Figure 5A:
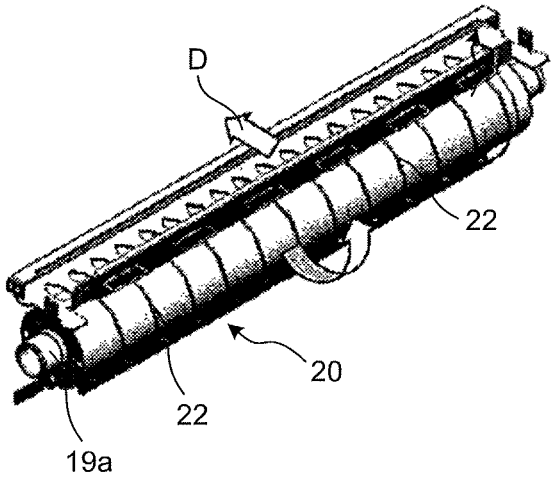
FIGS. 5A and 5B are perspective views of an example of a first heating roller in FIG. 1 and a conveying guide arranged therearound.
Figure 5B:
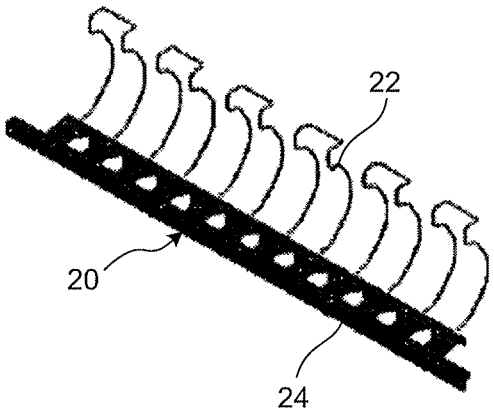

FIGS. 5A and 5B are perspective views of the first heating roller 19*a* and a conveying guide arranged therearound. FIG. 5A is a perspective view exemplifying a state in which a loading guide 20 as the conveying guide is attached to the first heating roller 19*a*. FIG. 5B is a perspective view exemplifying the loading guide 20. Although both FIG. 5A and FIG. 5B are perspective views, and are different in the viewpoint.

As illustrated in FIG. 5A, the loading guide 20 is attached around the first heating roller 19*a* and is fixed so as to maintain a certain distance to the outer peripheral surface of the first heating roller 19*a*. As illustrated in FIG. 5B, the loading guide 20 includes a guide 22 and a holder 24. The guide 22 is a guide member formed into a nearly U shape by bending wires with a curvature corresponding to the curvature of the surface of the heating roller 19, holds the recording medium 13 so as to wind the recording medium 13 around the first heating roller 19*a*, and guides the recording medium 13 so as to move the recording medium 13 in a certain conveying direction. The holder 24 supports the base of the guide 22. The other heating rollers 19 have a similar configuration.

With this configuration, the humid air generated around the first heating roller 19*a* flows upward through the wires of the guide 22, and the flow of the humid air is not hindered. As illustrated in FIG. 1, the heating rollers 19 are arranged so as to displace the positions of the side faces on the winding sides such that the rotational centers will have a positional relation not overlapping each other in the vertical direction. Consequently, the humid air generated around the heating roller 19 arranged below in the vertical direction in the conveying direction will not hit the heating roller 19 similarly arranged above to flow toward the exhaust port 12 as it is. Naturally, the humid air generated in the lower part in the vertical direction of the conveying path will not be in contact with the guide 22 of the other heating rollers 19 arranged above in the vertical direction of the conveying direction.

As described above, the exhaust configuration in the drying apparatus 1 has a plurality of effects. The guide 22 that covers the heating roller 19 has a wire configuration, whereby, first, the humid air generated around the heating roller 19 is exhausted by the exhaust equipment without being in contact with the recording medium 13 and the surrounding parts. Consequently, condensation on the guide 22 and the surrounding parts can be prevented from occurring. Second, the guide 22 is formed of the wires, whereby the surface area is small, which makes the flow of the humid air favorable. Although the loading guide 20 is close to the heating roller 19 and is a member on which condensation is most likely to occur owing to a temperature difference between the inside and the outside, the guide 22 is formed of the wires, whereby condensation can be prevented from occurring.

Figure 6:
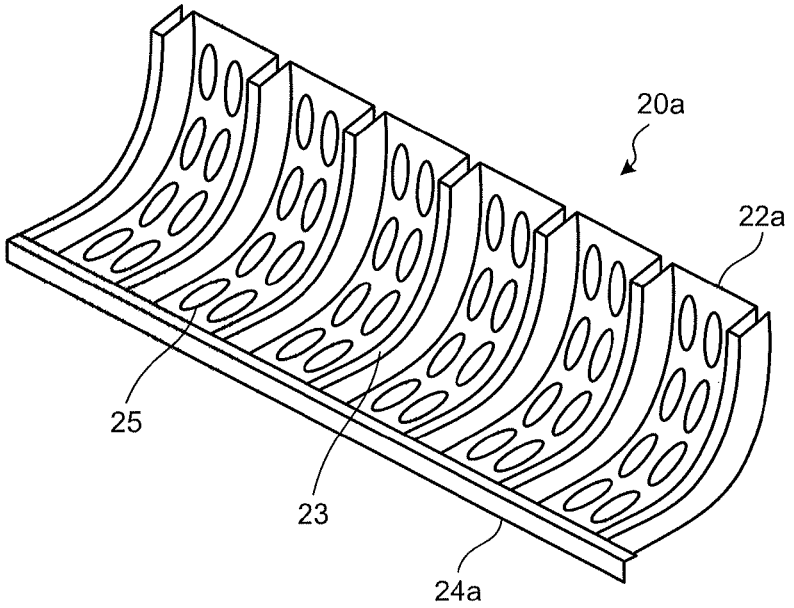
FIG. 6 is a perspective view of another example of the conveying guide arranged around the first heating roller in FIG. 1.

The guide 22 is not limited to the wires. As illustrated in FIG. 6, for example, a loading guide 20*a* according to another embodiment may include a guide 22*a* and a holder 24*a* of the heating roller 19 similarly to the already described loading guide 20. The guide 22*a* that the loading guide 20*a* illustrated in FIG. 6 includes is a guide member obtained by bending a plate-shaped member such as sheet metal with a curvature corresponding to the curvature of the surface of the heating roller 19 and forming a plurality of ribs 23 at regular intervals in the longitudinal direction of the curvature surface. The loading guide 20*a* also holds the recording medium 13 so as to wind the recording medium 13 around the heating roller 19 or the like and guides the recording medium 13 so as to move the recording medium 13 in a certain conveying direction.

In the guide 22*a*, the ribs 23 exhibit a function as guide members that guide the conveyance of the recording medium 13, and vent holes 25 in recessed parts in between the ribs 23 exhibit a function of passing the humid air generated from the recording medium 13 by heat transfer from the heating roller 19 therethrough upward. With these functions, the humid air is exhausted by the exhaust equipment without being in contact with the recording medium 13 and the surrounding parts. Consequently, condensation on the loading guide 20*a* and the surrounding parts can be prevented from occurring.

Although the present embodiment describes the recording medium 13 used as the conveyed object and the inkjet printer as the printing apparatus 21 as examples, the conveyed object includes band-shaped objects such as continuous or web-shaped sheets and films. The inkjet printer is exemplified as a representative of the apparatuses that discharge liquid including a liquid discharge head that discharges liquid; the present embodiment can be applied to all apparatuses that discharge liquid of other forms.

Figure 8:
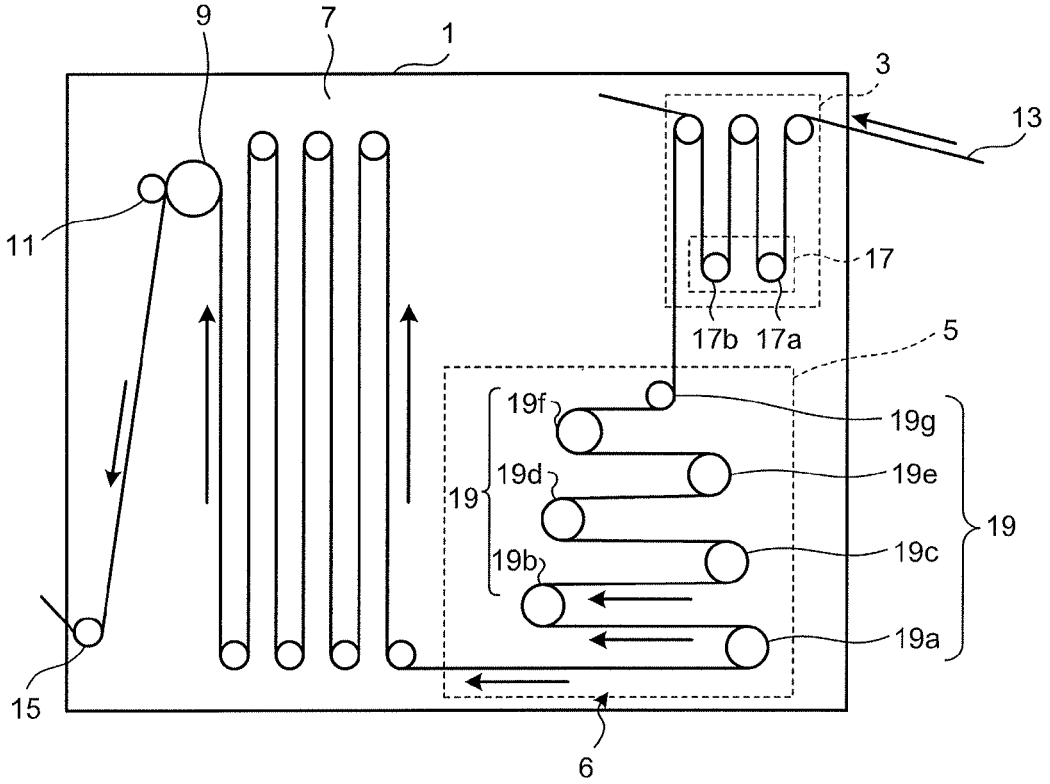
FIG. 8 is a view of an overall configuration of a drying apparatus according to another embodiment of the present invention.

Although the below in the vertical direction of the conveying path is the upstream of conveyance, whereas the above is the downstream of conveyance in the present embodiment, the positions of the upstream and the downstream of the conveying path may be reversed as illustrated in FIG. 8. In other words, the above in the vertical direction of the conveying path may be the upstream of conveyance, whereas the below in the vertical direction of the conveying path may be the downstream of conveyance. Thus, even when the positions of the upstream and the downstream of the conveying path are different, effects similar to the effects of the already described embodiment can be achieved.

Figure 11:
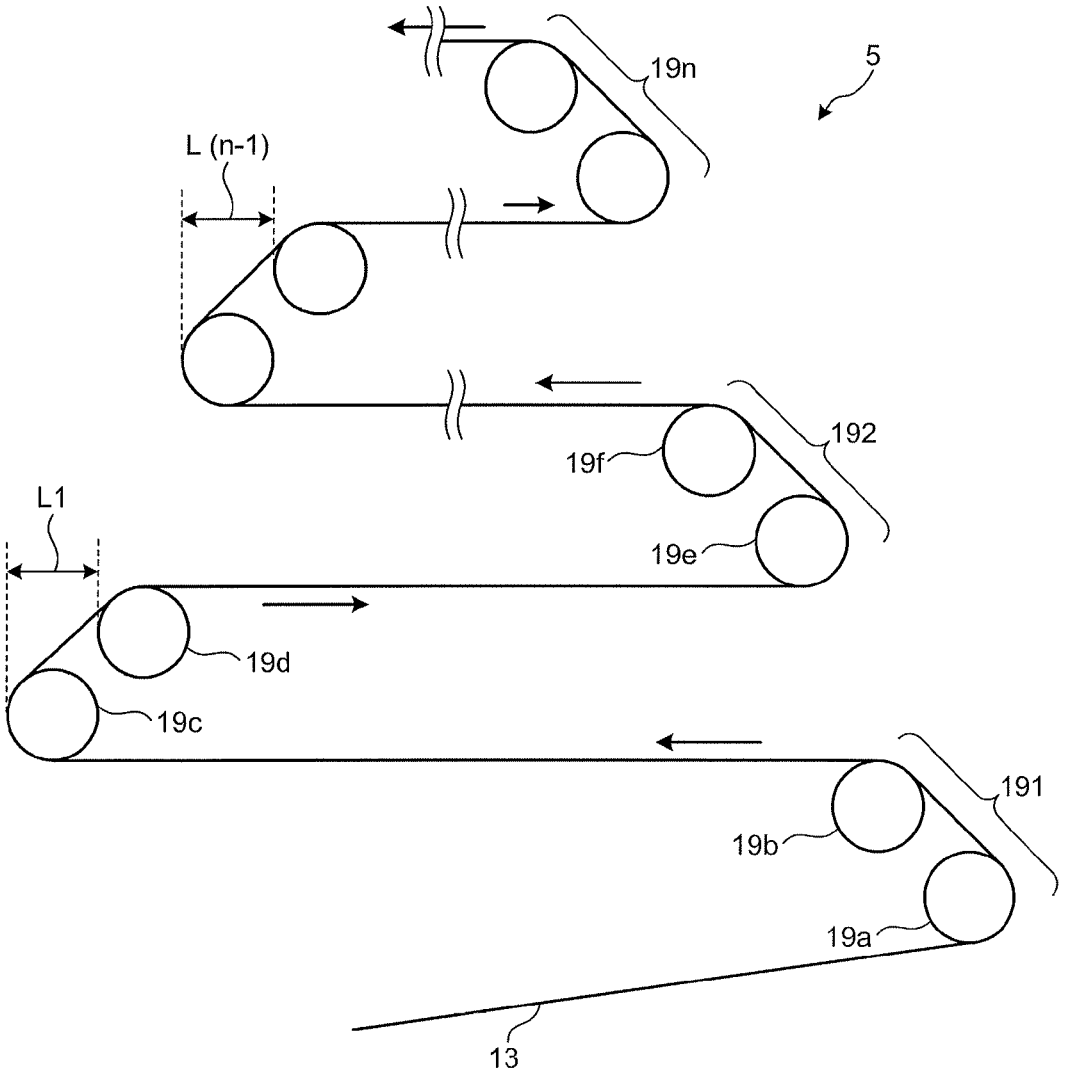
FIG. 11 is a view explaining another example of the roller arrangement in the drying apparatus according to the present invention.

The following describes another embodiment of the drying apparatus according to the present invention. FIG. 11 is a view of an arrangement example of the heating rollers 19 according to the present embodiment. As illustrated in FIG. 11, two heating rollers 19 are arranged at one side of turning back positions in the horizontal direction of the conveying path of the recording medium 13. A first roller 191 arranged most upstream and a second roller 192 that is arranged downstream of the first roller 191 and immediately thereabove each include two heating rollers 19, for example. One of the two heating rollers 19 may be a conveying roller obtained by omitting the heating unit from the heating roller 19.

As in the present embodiment, even when the arrangement of the heating rollers 19 forming the conveying path of the recording medium 13 within the drying unit 5 arranges two heating rollers at each end in the horizontal direction, the humid air is efficiently exhausted by the exhaust equipment without being in contact with the recording medium 13 and the surrounding parts. With this arrangement, condensation caused by the humid air can be prevented from occurring.

Figure 12:
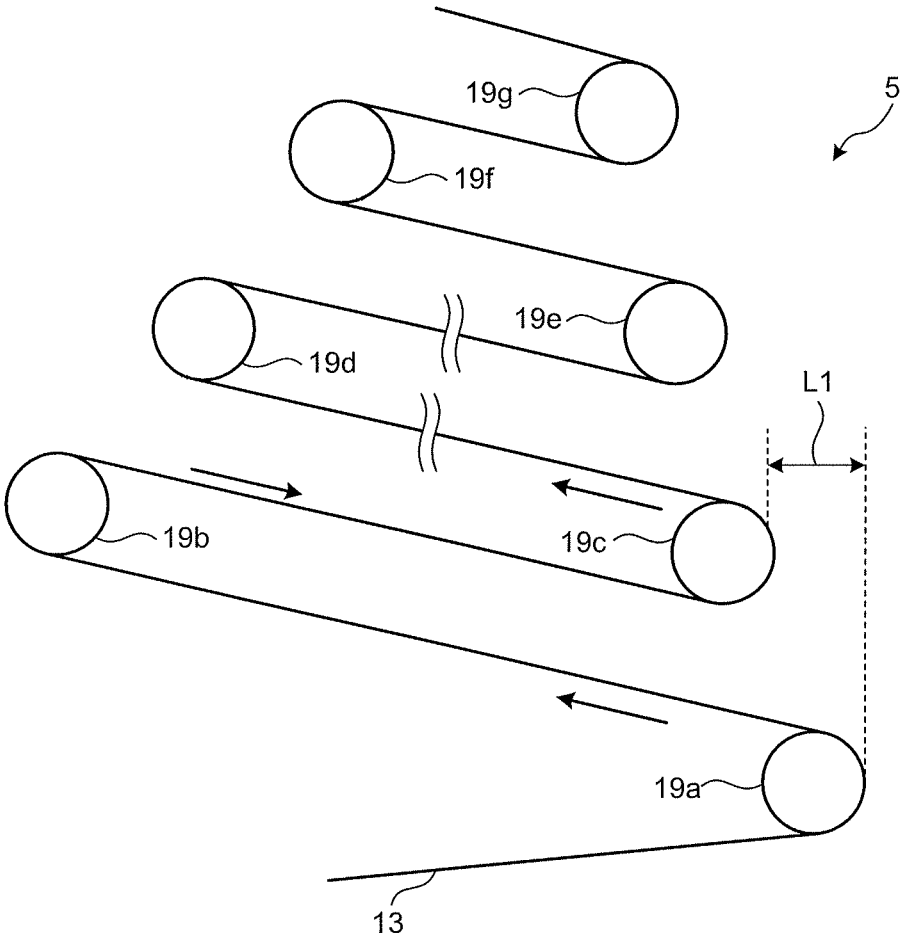
FIG. 12 is a view explaining still another example of the roller arrangement in the drying apparatus according to the present invention.

The following describes still another embodiment of the drying apparatus according to the present invention. FIG. 12 is an example of arranging the heating rollers 19 obliquely not in the horizontal direction. As illustrated in FIG. 12, the heating rollers 19 are arranged so as to convey the recording medium 13 while turning back the conveying path. Although the below in FIG. 12 is the upstream, whereas the above is the downstream, which may be reversed. The vertical tangential line of the side face on the winding side of the heating rollers 19 arranged below in the vertical direction of the drying unit 5 may be located outside in the horizontal direction than the vertical tangential line of the side face on the winding side of the heating rollers 19 arranged above in the vertical direction.

As in the present embodiment, even when the arrangement of the heating rollers 19 forming the conveying path of the recording medium 13 within the drying unit 5 is made oblique relative to the horizontal direction, the humid air is efficiently exhausted by the exhaust equipment without being in contact with the recording medium 13 and the surrounding parts. With this arrangement, condensation caused by the humid air can be prevented from occurring.

As described above, the drying apparatus 1 in the embodiments combines a plurality of heating rollers 19 to form the conveying path where the recording medium 13 is wound to be heated and conveyed. The recording medium is wound around the heating rollers 19 to be heated, whereby a surplus solvent and water remaining on the print face will evaporate to be dried.

This conveying path of the recording medium 13 is set such that the end faces on the winding sides of the recording medium 13, of the heating rollers 19 arranged at the positions arranged in the vertical direction and at the same side from the upstream in the conveying direction to the downstream in the conveying direction is located inside viewed in the vertical direction (opposite to the direction toward the end face on the winding side) relative to the end face on the winding side of the recording medium 13, of the heating roller 19 located upstream in the conveying direction.

With this arrangement, when vapor generated at the downstream in the conveying path moves upward, the vapor can be prevented from adhering to the heating rollers 19 and the guide 22 mounted on the heating rollers 19 and from condensing. In addition, the humid air that is generated in the heating roller 19 arranged immediately therebelow and ascends does not directly hit the recording medium 13, and condensation does not occur on the recording medium 13 either.

The drying apparatus 1 in the embodiments includes the guide 22 that includes the ribs 23 formed by sheet metal processing on a part of the guide 22 and has the vent holes 25 in between the ribs 23 on the outer peripheral part of the heating roller 19. With this configuration, the humid air generated by the heat transfer from the heating rollers 19 is efficiently exhausted upward.

The drying apparatus 1 in the embodiments forms the guide 22 of the wire members, whereby the humid air generated by the heat transfer from the heating rollers 19 is efficiently exhausted upward.

The drying apparatus 1 in the embodiments uses the interval changing mechanism (the approaching-and-separating mechanism 199) that changes the position of the end face on the winding side of the recording medium 13, of the heating roller 19 and a controller that changes the position of the end face on the winding side based on the preset change condition, whereby the heating rollers 19 can be changed to an optimum arrangement. For the change condition, the print area, the print density, the conveying speed of the recording medium 13, the temperature of the heating roller 19, and the temperature and the humidity within the chamber 6 can be used. In addition, these conditions may be multiplied to set the positions of the end faces on the winding sides of the respective rollers giving the optimum arrangement. With this processing, the optimum arrangement of the heating rollers 19 can be set in various environmental conditions surrounding the recording medium 13 conveyed in the drying apparatus 1. With this setting, the condensation of a solvent or water owing to a temperature difference within the drying apparatus 1 and the condensation of a solvent or water on the recording medium 13 can be prevented from occurring.

The already described conveying system 100 includes the drying apparatus 1 and the printing apparatus 21 that is arranged preceding the drying apparatus 1, performs printing on the recording medium 13, and conveys the recording medium 13 to the drying apparatus 1 and can thereby produce the above-described effects.

A method of drying according to the present embodiment arranges a plurality of heating rollers 19 such that the positions of the side faces on the winding sides does not overlap each other in the up-and-down positions in the vertical direction of the conveying path and can thereby dry the recording medium 13 while conveying the recording medium 13 without causing condensation on the guide 22 and the recording medium 13 even when the recording medium 13 is heated and dried while being conveyed wound around the heating rollers 19.

An embodiment can prevent condensation occurring on a recording medium or a guide in a conveying path caused by the vaporization of a solvent or water from the recording medium in a conveying path.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A drying apparatus comprising:

a plurality of rollers including at least one heating roller arranged to form a conveying path where a conveyed object is wound to be conveyed in a winding conveyance direction, a first subset of rollers amongst the plurality of rollers being arranged on a first side in a horizontal direction, and a second subset of rollers amongst the plurality of rollers being arranged on a second side opposite to the first side in the horizontal direction; and an exhaust unit disposed above the conveying path, wherein the conveyed object is conveyed along the conveying path windingly back and forth between the first side and the second side, the winding conveyance back and forth between the first side and the second side advancing the conveyed object upwardly or downwardly in a vertical direction, and the conveying path includes plural horizontal sections, one disposed above another, and amongst the plural horizontal sections, each horizontal section is shorter than the horizontal sections below the horizontal section.

2. The drying apparatus according to claim 1, wherein each of the rollers includes a guide member around an outer peripheral part of the roller, and the guide member is formed of a plate-shaped member having vent holes.

3. The drying apparatus according to claim 1, wherein each of the rollers includes a guide member around an outer peripheral part of the roller, and the guide member is formed of a wire member.

4. The drying apparatus according to claim 1, further comprising:

an interval changing mechanism configured to change positions of the rollers in a horizontal direction of the conveying path; and a controller configured to change the positions in the horizontal direction based on a preset change condition.

5. The drying apparatus according to claim 4, wherein the change condition includes a print area and a print density to be printed on the conveyed object.

6. The drying apparatus according to claim 4, wherein the change condition includes a conveying speed of the conveyed object.

7. The drying apparatus according to claim 4, wherein the change condition includes a temperature of the heating roller.

8. The drying apparatus according to claim 4, wherein the change condition includes a temperature and a humidity within a chamber in which the heating roller is arranged.

9. A conveying system comprising:

the drying apparatus according to claim 1; and a printing apparatus arranged upstream relative to the drying apparatus, and configured to perform printing on the conveyed object, and convey the conveyed object to the drying apparatus.

10. The drying apparatus according to claim 1, wherein the conveyed object is advanced upwardly or downwardly in the vertical direction as the conveyed object is conveyed along an outer peripheral part of the roller.

11. The drying apparatus according to claim 1, wherein each roller amongst the plurality of rollers includes a guide member around an outer peripheral part of the roller, the conveyed object is transferred in the horizontal direction while being conveyed from one guide member to a next guide member in the conveying path, and the conveyed object is advanced upwardly or downwardly in the vertical direction as the conveyed object is conveyed, guided by the guide member, along the outer peripheral part of the roller.

12. The drying apparatus according to claim 1, wherein each of the rollers includes a guide member around an outer peripheral part of the roller, and the conveyed object is transferred in a direction inclined relative to a horizontal direction while being conveyed from one guide member to a next guide member in the conveying path.

13. The drying apparatus according to claim 1, wherein in each subset amongst the first subset and the second subset, a center of a roller in the subset is shifted obliquely both in the horizontal direction and in the vertical direction from a center of an adjacent roller in the same subset.

* * * * *